US005662244A

United States Patent [19]

Liu et al.

[11] Patent Number: 5,662,244

[45] Date of Patent: Sep. 2, 1997

[54] TOY WEAPON FIRING A LIQUID PROJECTILE

[75] Inventors: Dexter Chih-Teh Liu, Portsmouth, R.I.; Douglas F. Melville, Jr., Simsbury, Conn.

[73] Assignee: LCD International, L.L.C., Newport, R.I.

[21] Appl. No.: 502,416

[22] Filed: Jul. 14, 1995

[51] Int. Cl.[6] ..... B67D 5/42

[52] U.S. Cl. ..... 222/79; 222/153.13; 222/380; 222/494

[58] Field of Search ..... 222/38, 78, 79, 222/153 B, 324, 340, 372, 380, 385, 384, 386, 387, 494, 495, 402, 401; 446/405, 473, 475

[56] References Cited

U.S. PATENT DOCUMENTS

| | | | |
|---|---|---|---|
| 54,783 | 5/1866 | Scotton . | |
| 2,302,963 | 11/1942 | Lefever | 221/31.5 |
| 2,706,067 | 4/1955 | Mills | 222/340 |
| 2,753,079 | 7/1956 | Hersey | 222/324 |
| 3,022,779 | 2/1962 | Benkoe | 124/11 |
| 3,365,838 | 1/1968 | Butler et al. | 46/175 |
| 3,412,503 | 11/1968 | Ryan et al. | 46/84 |
| 3,758,005 | 9/1973 | Christine et al. | 222/380 |
| 3,782,598 | 1/1974 | Basa | 222/340 |
| 4,114,080 | 9/1978 | Greenwood | 446/405 |
| 4,591,071 | 5/1986 | Johnson | 222/39 |
| 4,757,946 | 7/1988 | Johnson | 239/99 |
| 4,765,510 | 8/1988 | Rende | 222/39 |
| 4,834,059 | 5/1989 | Moorhouse et al. | 124/67 |
| 4,867,208 | 9/1989 | Fitzgerald et al. | 141/18 |
| 4,961,718 | 10/1990 | Wu | 446/406 |
| 5,052,587 | 10/1991 | Graves | 222/79 |
| 5,197,637 | 3/1993 | Naumann | 222/494 |
| 5,284,274 | 2/1994 | Lee et al. | 222/79 |
| 5,303,848 | 4/1994 | D'Andrade | 222/79 |
| 5,322,191 | 6/1994 | Johnson et al. | 222/79 |
| 5,339,987 | 8/1994 | D'Andrade | 222/79 |
| 5,419,458 | 5/1995 | Mayer | 222/79 |

*Primary Examiner*—Philippe Derakshani

*Attorney, Agent, or Firm*—Panitch Schwarze Jacobs & Nadel, P.C.

[57] ABSTRACT

A toy weapon for firing a charge of water includes a housing, water reservoir and a reciprocating piston mounted within a tube in the housing. The tube has a spring-biased, hinge mounted flap valve located at one end of the tube to effectively close the tube end. This valve also creates a sufficiently air-tight seal to allow the water charge to be suctioned from the reservoir into the tube. The tube holds the water charge, which is drawn into the tube on a back stroke of the piston, through a one-way valve in a conduit that connects the reservoir with the tube. The weapon is fired on a forward piston stroke, the water charge being pressurized in the tube and released as a single slug or burst of large droplets when the flap valve opens under increasing pressure of the water charge. A nozzle is provided downstream from the flap valve to help keep the water charge together and increase the velocity of the water as it is discharged from the weapon. A mechanical sound generator can be provided operated by movement of the piston shaft.

19 Claims, 2 Drawing Sheets

TOY WEAPON FIRING A LIQUID PROJECTILE

FIELD OF THE INVENTION

The invention relates to a toy weapon and, in particular, a toy gun for firing a compressed charge of water as the projectile.

BACKGROUND OF THE INVENTION

Firearm simulating weapon toys that fire a liquid such as water are well known. Toy water guns have been a safe and popular children's toy for decades. Toy water guns have enjoyed continued popularity because they raise the level of realistic play above non-projectile-firing toy weapons. A high level of enjoyment is achieved with these toy weapons because they simulate real firearms by firing a projectile, a stream of water, and, if the shooter's aim is good, the opponent is actually hit.

Many prior art toy water guns are squirt-type devices in which the water under pressure is ejected as a water stream, usually through a small orifice or constricting nozzle. The water pressurization may be achieved either by pumping action or by air pressurization of the water.

Exemplary of such prior art water guns are those described in U.S. Pat. No. 2,302,963 of Lefever, U.S. Pat. No. 3,365,838 of Butler et al., U.S. Pat. Nos. 4,591,071 and 4,757,946, both of Johnson, U.S. Pat. No. 5,052,587 of Graves, U.S. Pat. No. 5,284,274 of Lee et al. and U.S. Pat. No. 5,339,987 of D'Andrade.

A disadvantage of such prior art water guns is that the shooter must be relatively precise in aiming to insure that the water stream hits the intended target.

The present invention provides the popular advantages of traditional water guns, but projects a water charge that may be in the form of a burst or shower of water that is more likely to land on the intended target without the need for precision in aiming.

SUMMARY OF THE INVENTION

In one aspect, the invention is a toy weapon for firing a charge of water comprising: a housing defining a body of a toy weapon; a tube supported by the housing, the tube defining a firing chamber to hold a charge of water; a pivotally mounted flap valve located at one end of the tube through which end a water charge exits under pressure upon firing of the charge, so as to effectively close the one end of the tube sufficiently to retain a static charge of water in the tube; a water reservoir external to the tube; a conduit coupling the reservoir to the tube in proximity of the flap valve; a one-way valve located between the reservoir and the tube and oriented to permit water to be drawn from the reservoir into the firing chamber; and a piston mounted to reciprocate within the tube, such that the piston draws the charge of water from the reservoir into the firing chamber on a back stroke and pressurizes the charge in the firing chamber on a forward stroke.

Another aspect of the invention is an improvement in a cocking and release mechanism in a spring-operated toy weapon having a housing in the shape of a weapon and having an operational firing assembly containing a shaft operatively linked to a shaft spring that biases shaft movement in a longitudinal direction, which improvement comprises: (i) a cocking lever, pivotally attached to the housing; (ii) a cocking latch, having a bore hole, slightly larger than the shaft diameter, through which the shaft passes; (iii) a cocking latch spring positioned to bias the cocking latch into a position that maintains the bore hole centerline and shaft centerline in a relationship sufficiently coaxial to permit the shaft to slide loosely through the bore hole; (iv) a rotary member associated with the cocking lever and positioned proximate to the cocking latch, the rotary member being rotatable by manual movement of the cocking lever about a pivot point to make contact with the cocking latch and to misalign the cocking latch bore hole sufficiently with respect to the shaft to effect frictional engagement of the shaft with at least a portion of the bore hole periphery to move the shaft in a back stroke direction; (v) a trigger latch in contact with the shaft so as to prevent the shaft from moving in a forward stroke direction when coaxial with the cocking latch bore hole; and (vi) a trigger finger grip portion protruding beyond the exterior of the housing and operatively linked to the trigger latch so as to release the shaft from the trigger latch.

BRIEF DESCRIPTION OF THE DRAWINGS

The foregoing summary, as well as the following detailed description of the preferred embodiments, is better understood when read in conjunction with the appended diagrammatic drawings. For the purpose of illustrating the invention, there are shown in the drawings embodiments which are presently preferred. It should be understood, however, that the invention is not limited to the specific instrumentalities, arrangements or methods disclosed. In the drawings which are diagrammatic.

DESCRIPTION OF THE PREFERRED EMBODIMENT

Figure 1:
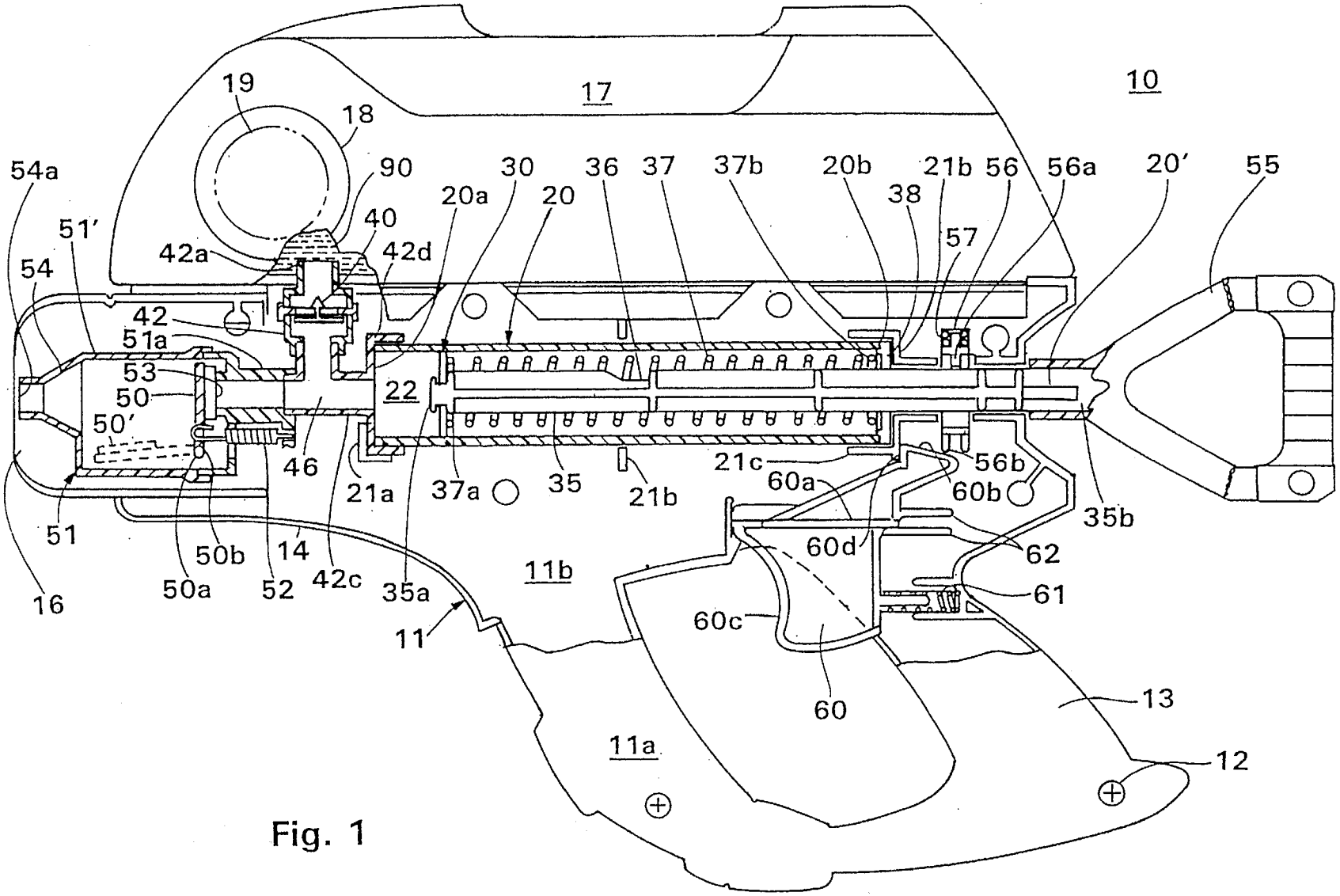
FIG. 1 is a partially broken away side elevation view of a first embodiment toy weapon according to the present invention.

Certain terminology is used in the following description for convention only and is not limiting. The words "right," "left," "lower," "upper," "top," "bottom," "horizontal," "vertical," "forward," "rearward," "back," "backward" and "under" designate directions in the drawings to which reference is made. The words "inward" and "outward" refer to directions towards and away from, respectively, the geometric center of the device or designated parts thereof. The word "forward" refers generally to a direction in which the liquid projectile exits the device upon firing.

Referring now to the drawings in which like numerals are used to reference like elements throughout, there is shown in FIG. 1 a toy weapon indicated generally at 10 for firing a charge of liquid, hereinafter referred to as water, the preferred liquid, indicated generally at 90.

Major components of the toy weapon are seen partially in phantom in FIG. 1. The weapon has several major preferred components: a housing 11, a water reservoir 17, a tube 20, a reciprocating piston 30 and a pivotally mounted hinge valve 50.

The housing 11 may be provided in any of a variety of ways, using conventional toy materials such as plastics, metals, or the like. A pair of mating shells 11*a*, 11*b* is preferred. The shells may be held together with removable fasteners 12. Alternatively, fixed fasteners, adhesives, or other conventional means (none shown) may be used.

The housing 11 generally defines the shape or appearance of the toy weapon, a pistol shape being depicted in FIG. 1. It should be apparent from the disclosure herein that the toy weapon may be in the shape of a gun, e.g., pistol or rifle, or other weapon type typically associated with the firing of a projectile or injury/damage-causing means. The weapon appearance may be realistic or fanciful and imaginative.

It should be appreciated that a preferred embodiment is a toy weapon that is sufficiently small and light enough to be handled and operated by a child.

The housing 11 of the embodiment depicted in FIG. 1 includes a pistol grip portion 13 designed for ease of use by a child. The portion 14 of the housing forward of the pistol grip may also serve as a forward hand grip, an additional support point of the weapon.

The water reservoir 17 associated with the housing may be an integral part of the housing or may be separate from, but attached to, the housing, as depicted in FIG. 1. The water reservoir 17 holds a volume of liquid sufficient to fire the weapon many times without refilling, e.g., holding between 0.3 to 3 liters of liquid.

As with the housing, a pair of mating shells (not shown) is preferred for the water reservoir 17. The mating portions of the water reservoir 17 are sealed by fusing to be water-tight, but other conventional means like gasket material may be used to make the reservoir 17 relatively leak-free.

The water 90 or other suitable liquid is introduced into the reservoir 17 through an opening 19 (in phantom) normally sealed with a removable cap 18 that provides a water-tight seal when in place.

Still referring to FIG. 1, the tube 20 is mounted within the housing 11 and is maintained in a fixed position with tube support means. Molded in forward, middle and rearward ribs are shown at 21*a*, 21*b*, 21*c*, respectively, but other conventional holding means may be provided inside the housing 11. The tube 20 is oriented such that a forward, or firing, end 20*a* is pointed at the firing end of the toy weapon, i.e., in the direction that the water charge 90 is projected upon firing of the toy weapon.

Within the tube 20 is mounted the piston 30 which is capable of moving in reciprocal movement along the longitudinal axis 20' of the tube, in a forward stroke towards the firing end 20*a* of the tube or in a back stroke towards the other end 20*b* of the tube. The diameter of the piston 30 is sufficient, with respect to the inside diameter of the tube, to provide a generally water-tight and air-tight seal between the tube wall and the circumference of the piston. Conventional piston sealing means such as O-rings (not depicted) may be used to provide an effective seal while still permitting reciprocal movement of the piston 30.

Reciprocal movement of the piston 30 is accomplished with a piston shaft 35 attached to the piston. The piston shaft 35 is generally cruciform shaped in cross section. In FIG. 1, one end 35*a* of the shaft 35 is secured at the center of the piston 30 by being stretched over the end of the piston 30 as shown or by being attached by other conventional means, e.g., with a permanent adhesive, a fastener, etc.

The tube 20 is preferably a metal or relatively rigid plastic such as PVC or ABS while the piston 30 is preferably a relatively softer and resilient or even elastic polymer such as neoprene, a soft vinyl formulation or a thermoplastic elastomer such as KRATON® styrene-butadiene elastomer.

The piston 30 is biased to move in a forward direction by piston spring 37 that is a coil spring located concentrically with the piston shaft 35 and that has one spring end 37*a* in contact with the base of the piston 30 and the other spring end 37*b* in contact with a spring retainer 38 mounted at the rear end 20*b* of the tube. As shown in FIG. 1, the rear end 35*b* of the piston shaft passes through the spring retainer 38 through an opening in the center of the retainer.

At the firing end 20*a* of the tube 20, in proximate location to the piston 30 at the end of its forward stroke, are two valve components.

The first is a one-way valve 40, a flap valve being shown in FIG. 1 that is located at the upper one end 42*a* of a tee shaped conduit 42 fluidly connecting the water reservoir 17 with the firing end 20*a* of the tube 20 and a nozzle assembly 51. When the piston 30 is moved in a back stroke, causing the coil spring 37 to be compressed, a partial vacuum is created in the space 22 defined by the rearward displacement of the piston 30 in the tube 20, such space also being called the firing chamber, and this causes water in the reservoir 17 to be drawn by suction through the opened flap valve 40 into the firing chamber 22. The forward stroke of the piston 30, towards the firing end 20*a* of the tube, causes pressurization of the water 90 in the firing chamber 22 that ensures that the one-way valve 40 remains closed, thus preventing the water in the firing chamber from being returned to the water reservoir 17.

A second valve located in proximity to the firing end 20*a* of the tube 20 is the pivotally mounted flap valve 50, an important element in this invention. The flap valve 50 is preferably hinge mounted at one end, its lower end in FIG. 1, to and contained in a housing 51' of nozzle assembly 51. The rear 51*a* of the nozzle assembly is fluidly coupled or connected to the firing end 20*a* of the tube 20 through a horizontal portion 42*c* of the conduit 42. End 42*b* mates to housing 51' while end 42*d* is enlarged into a cap portion receiving and sealing with the forward end 20*a* of tube 20.

The preferred hinge mounted flap valve 50 contained in the nozzle assembly 51 is substantially rigid and normally maintained in a closed position through the action of a spring 52. Valve 50 provides an effective air and water-tight seal preferably by means of a soft flexible gasket material 53, that is affixed to the tube closing side of the valve flap 50. Flap valve 50 is supported on a pair of fork arms (one being shown at 50*a*) for rotation about pivot point 50*b*. Spring 52 is located relatively close to the pivot point 50*b* so as to minimize the torque increase required to rotate the valve 50 to open. As the valve opens, the fork arms permit the spring 52 to move to a nearly on-center position thereby reducing the torque needed to complete the opening of flap valve 50 to nearly zero. The inside of the housing 51' acts as a stop. The gasket material 53 maintains an air tight seal so that when the piston 30 is retracted, water can be suctioned from the reservoir 17. When the water charge 90 in the firing chamber 22 is pressurized, via the forward stroke of the piston 30, the water pressure increases to a point that overcomes the flap valve spring force and the flap valve 50 opens, as shown by the phantom representation of the open flap valve indicated at 50' in FIG. 1.

A water-tight seal is maintained by the gasket material 53 as the piston 30 is advanced until the force of the spring 52 is overcome. Material 53 is preferably a relatively resilient or elastic thermoplastic softer than the end of conduit 42 on which it seats. The spring force need only be sufficiently great to essentially retain a full charge of water in the firing chamber 22 when the piston 30 is fully retracted and the weapon 10 is held in a vertical orientation with the nozzle end down. Even some seepage can be permitted as long as it does not result in significant immediate water loss from chamber 22. A slightly greater spring force is actually desired to keep the valve closed even when the weapon is shaken in the vertical position or dropped with a full charge of water in the firing chamber as might occur in play.

The nozzle assembly 51 also includes a nozzle 54 at the forward end of the assembly, with a reducing cone shape and reduced diameter opening 54*a* oriented such that the water charge exiting the flap valve 50 is directed in a forward, or firing, direction with respect to the toy weapon 10. The housing 11 of the toy weapon has an opening 16 that provides the nozzle opening 54*a* with unimpeded direct fluid access to the open atmosphere outside of the housing 11.

Other components of the toy weapon 10 depicted in FIG. 1 include an assembly for cocking and firing the toy weapon. The piston shaft 35, at the end 35*b* opposite from the end 35*a* affixed to the base of the piston, is attached to a cocking handle 55. The cocking handle 55 is located outside of the housing 11 at the rear portion of the toy weapon 10 and is designed to be manually pulled in a rearward direction by the operator of the toy weapon. Such rearward pull effects a back stroke of the piston 30. This movement causes the firing chamber 22 to fill with water 90 as described previously.

The piston shaft 35 shown in FIG. 1 contains a notch 36, located between the piston 30 and the cocking handle 55 approximately one-third of the distance from the piston. A latch member 56 is located and operatively mounted within housing 11 to engage notch 36 when piston 30 is drawn back sufficiently to a cocked position and enables the piston 30, biased to move in a forward stroke direction by the compressed coil spring 37, to be retained in the cocked position until the weapon 10 is ready to be fired.

When the piston 30 and piston shaft 35 are drawn fully rearwards with the cocking handle 55 in a back stroke, the notch 36 in the shaft is engaged by the latch member 56 that is slidably mounted on body shell 11*b* and that contains a protuberance 56*a* which is biased by a coil spring 57 into the piston shaft notch 36. The cocking handle 55 may then be released, since the protuberance 56*a* of the latch member 56 remains engaged with the notch 36 in the shaft 35, preventing forward travel of the piston 30 and its shaft 35. This maintains the toy weapon 10 in a cocked, ready-to-fire state.

The cocked weapon 10 is fired via a trigger assembly. The trigger assembly consists of a trigger 60, which is biased to move in a forward direction by a trigger spring 61 and is slidably mounted in the housing 11 with ridges 60*a* on both sides of the trigger that engage with guide rails 62 in the housing 11. The trigger has a cam portion 60*b* that engages a lower portion 56*b* of the latch member 56. When the trigger 60 is moved in a rearward direction to compress the trigger spring 61, as by manually pulling the trigger finger grip portion 60*c* with a finger, the trigger cam 60*b* moves the latch member 56 upwards, compressing the latch member coil spring 57 and disengaging the latch member protuberance 56*a* from the notch 36 in the piston shaft.

The piston 30 and its shaft 35 are then free to move in a forward stroke under the bias of the piston spring 37, firing the toy weapon. Upon release of the trigger 60, the trigger moves forward under the bias of the trigger spring 61 until the trigger stop 60*d* makes contact with the tube lower rear support member 21*c*, as shown in FIG. 1.

Operation of the toy weapon 10 depicted in FIG. 1 is as follows. The water reservoir 17 is filled with water through the cap opening 19 and the cap 18 is used to close the opening 19 with a substantially water-tight though necessarily not air-tight seal. The firing chamber 22 is charged with water 90 from reservoir 17 by drawing the cocking handle 55 rearwards. This action creates a partial vacuum in the firing chamber 22, which draws water into the firing chamber 22 through the one-way valve 40 into the conduit 42 connecting the water reservoir 17 with the tube 20 and into the tube 20. When the cocking handle 55 is drawn to a fully cocked position, the latch member protuberance 56*a* engages the notch 36 in the piston shaft 35, and the weapon 10 is cocked and ready to be fired.

Firing of the toy weapon 10 is accomplished by aiming the forward end of the weapon at the intended target and manually pulling the trigger 60. The trigger 60 releases shaft 35, which carries the piston 30 in a forward stroke under the bias of the piston spring 37. The forward travel of the piston 30 causes pressure to build in the water-filled firing chamber 22. The one-way flap valve 40 in the conduit 42 between the water reservoir 17 and the tube 20 is held shut by the pressurized water in the firing chamber 22 and conduit 42. During the forward travel of the piston 30, pressure builds sufficiently in the water trapped in the firing chamber to overcome the force of spring 52, which causes the hinged flap valve 50 to open (as shown in phantom in FIG. 1), to release the pressurized charge of water 90 in the firing chamber 22. The water charge passes through the interior of the nozzle assembly 51 and exits the assembly 51 through the nozzle 54, in a direction towards the intended target. The nozzle 54 directs the released water charge as a slug or a spray of a limited number of very large droplets of water in the preferred embodiment of this invention. It should be evident from the disclosure herein that use of a sufficiently small orifice in the constricted end 54*a* of the nozzle will create more of a stream effect, rather than the preferred slug of water or burst of large drops.

Figure 2:
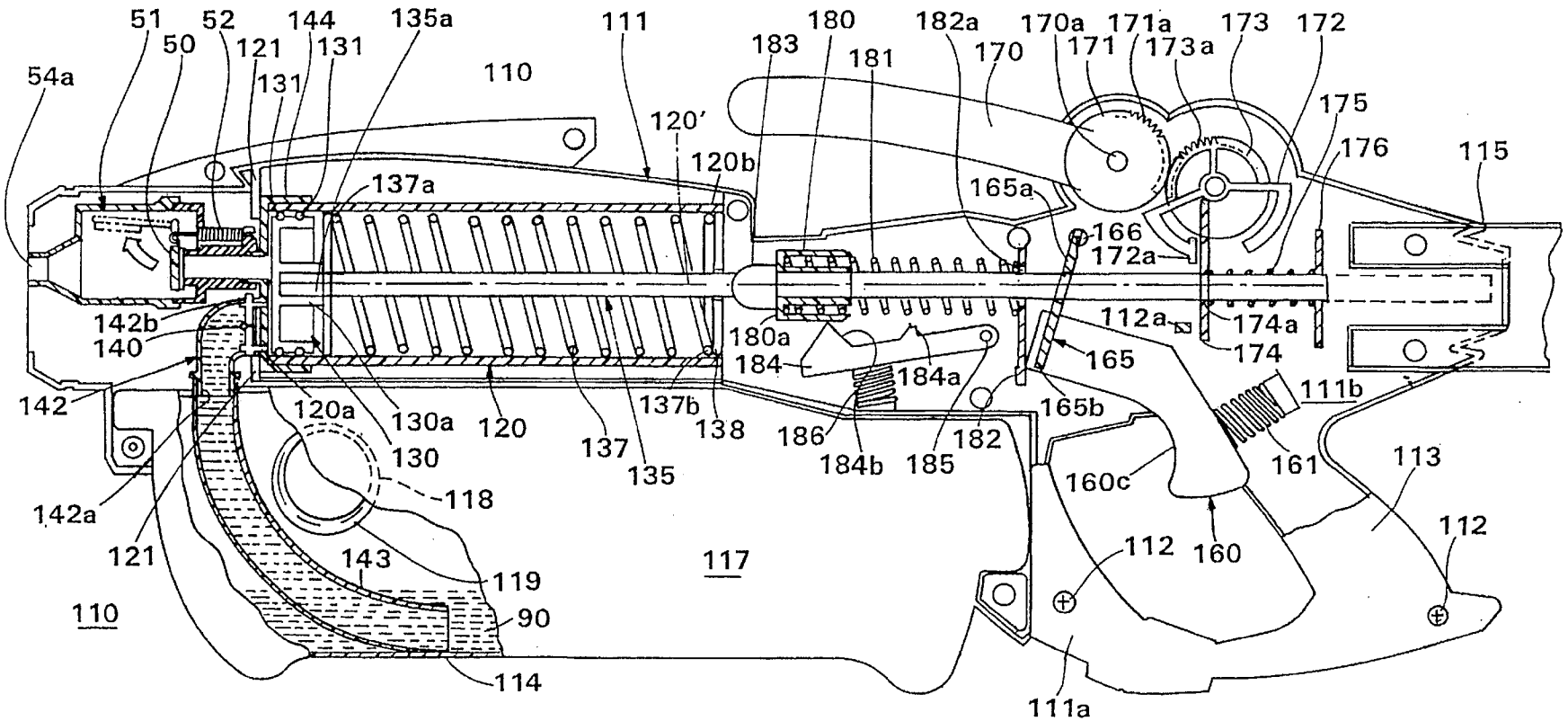
FIG. 2 is a partially broken away side elevation of a second embodiment toy weapon of the present invention.

Referring now to FIG. 2, a second embodiment of the toy weapon of this invention is shown generally as 110. In many respects, the toy weapon 110 depicted in FIG. 2 is similar to that embodiment 10 shown in FIG. 1, but differences are explained in more detail below. The toy weapon 110 of FIG. 2 has several major components: a housing 111, a water reservoir 117, a tube 120, a reciprocating piston 130 and a nozzle assembly 51 preferably identical to nozzle assembly 51 of FIG. 1 including a hinged flap valve 50.

The housing 111 of the toy weapon of FIG. 2 is in the general shape of a rifle, in contrast to the pistol shape shown in FIG. 1. The housing 111 of the embodiment in FIG. 2 includes a conventional shoulder stock 115 (only the end of which is partially depicted) in addition to the pistol grip 113 shown in the figure. The two mating shells 111*a*, 111*b* of the housing 111 are secured with conventional removable fasteners 112 or other fasteners or conventional means.

The water reservoir 117 is located on the underside of the toy weapon 110 of FIG. 2, and may contain serrations (not depicted) or the like on its lower portion 114 that facilitate its use as a forward hand grip. The water reservoir 117 contains an opening 119 (in phantom) through which water 90 may be introduced, and this opening is preferably closed with a water-tight but not air-tight removable cap 118. Alternatively, a one-way valve may be provided to admit air into reservoir 117 when water is drawn from the reservoir. A siphon tube 143 in the reservoir 117 connects with the reservoir end 142*a* of conduit 142. A one-way check valve 140 is mounted in the tube end 142*b* of the conduit 142. A cap member 144 receives and is sealed with the forward end of the tube 120 as well as the tube end 142*b* of conduit 140 and the upstream end of nozzle assembly 51.

Still referring to FIG. 2, the tube 120 is mounted within the housing 111 between the upper inner side of the housing 111 and tube support member in each shell, the member in shell 111*b* being indicated at 115'. The piston 130 is mounted within the tube 120 for reciprocal movement along the longitudinal axis 120' of the tube 120. A water-tight seal between the piston circumference and tube wall is provided by conventional piston sealing means, such as one or a pair of O rings 131 as shown in the figure.

The base of piston 130 is attached to a piston shaft 135 in a conventional manner, via a sleeve portion 130*a* extending from the center of the base of the piston. Sleeve portion 130*a* is affixed, with adhesive or by crimping mechanical fastener, snap fit, etc., to the end 135*a* of the preferably solid piston shaft 135, which extends into the sleeve.

The piston 130 is biased in a forward direction by a piston spring 137, which is a coil spring located concentrically with respect to the piston shaft 135 and within tube 120 and which has one spring end 137*a* in contact with the base of the piston and the other spring end 137*b* in contact with a spring retainer 138 located at the rear end 120*b* of the tube 120. The spring retainer 138 has a hole in its center through which the piston shaft 135 extends and may slide freely.

At the firing end 120*a* of the tube 120 are located two valves. The first is a one-way valve 140, a flap valve being shown, that is positioned at the end of a conduit 142 connecting the water reservoir 117 with the firing end 120*a* of the tube 120. The valve 140 opens in response to the partial vacuum created when the piston 130 is moved in a back stroke, drawing water by suction from the water reservoir 117 into the firing chamber.

The second valve is the pivotally mounted, preferably hinged flap valve that is located in the nozzle assembly 51, which is fluidly coupled to the firing end 120*a* of the tube 120 and which is depicted in more detail in FIG. 1. The nozzle assembly 51 indicated in FIG. 2 is identical in structure to that shown in more detail in FIG. 1 except that it is inverted with the flap valve pivot located at the top of the flap valve 50 and spring 52 located at the top of the assembly 51 so as to fit more compactly into the housing 111.

Now referring to FIG. 2, weapon 110 preferably includes a cocking and firing assembly that differs from that depicted for the other embodiment 10 shown in FIG. 1. Cocking of the weapon 110 is accomplished with an assembly that effects rearward or backward travel of the piston shaft 135, through manual operation of a cocking lever or handle 170 located on the upper, exterior portion of the housing 111 near the shoulder stock attachment end of the housing 111 of the toy weapon. The cocking lever 170 preferably is pivotally attached to the housing 111 at pivot 170*a* and has a gear portion 171 that is operatively linked through teeth 171*a* to teeth 173*a* of a rotary member 172 that has a gear portion 173 with the teeth 173*a*. The rotary member 172 also has a shoulder 172*a* that engages a cocking latch preferably in the form of a cocking plate 174.

The cocking plate 174 has a bore hole 174*a* through which the solid piston shaft 135 slides freely when the bore axis of the cocking plate 174 and the shaft axis are sufficiently coaxial. The cocking plate 174 is normally biased into a coaxial position with respect to the piston shaft 135 by a cocking spring 175, which is concentric with the shaft 135 and which is held in position by a spring retainer 176 attached to or formed as a part of the housing 111. The spring biased forward travel of the cocking plate 174 can be limited by a stop 112*a* and by the shoulder 172*a* of the rotary member 172, at least when the cocking lever 170 is in a normal, "down" position, which is shown in FIG. 2.

Operation of the cocking lever 170, by manually pulling it upwards about its pivot point 170*a*, causes the shoulder 172*a* of the rotary member 172 to move backwards and to shift or push the cocking plate bore hole 174*a* centerline into a non-coaxial and, more particularly, a non-parallel position with respect to the piston shaft 135 centerline, which is coincidental with tube axis 120'. This movement causes the edge of the cocking plate bore hole 174*a*, i.e., at least a portion of the periphery, to engage frictionally with the shaft 135, sufficiently to move the shaft 135 in a backward direction and thereby cause the piston 130 to move in a back stroke as rotary member 172 rotates.

Forward movement of the piston shaft 135 is prevented, after the cocking lever 170 is returned from an "up" position to its original "down" position, by a trigger assembly. The trigger assembly includes a trigger member or "trigger" 160; a trigger latch preferably in the form of a trigger plate 165 that is pivotally mounted in the housing 111 at a pivot 166 and serves to restrain forward stroke travel of the piston shaft 135. The trigger plate 165 contains a bore hole 165*a* that allows the piston shaft 135 to slide freely when the trigger plate bore centerline and the piston shaft centerline are again sufficiently coaxial. The portion 165*b* of the trigger plate 165 opposite to the pivot 166 is affixed to the trigger 160. The trigger 160 includes a finger grip portion 160*c*, which protrudes from the pistol grip 113 of the housing 111. A trigger spring 161 biases the trigger 160 in a forward position that maintains the bore hole 165*a* of the trigger plate 165 in a non-coaxial, more particularly non-parallel position with respect to the piston shaft 135. The misalignment of the trigger plate bore hole 165*a* centerline and the piston shaft 135 centerline is sufficient to cause frictional engagement of the piston shaft 135 with at least a portion of the periphery of the trigger plate bore hole 165*a*. This frictional engagement restrains the piston shaft 135 from moving in a forward stroke direction, under the bias of the piston spring 137, after the shaft is moved rearward by cocking plate 174 and cocking plate 174 is released by rotary member 173.

The cocking lever 170 shown in FIG. 2 may be operated two or more times, in an upward pulling stroke, to move the piston shaft 135 and piston 130 to a fully cocked position, with the piston substantially compressing the piston spring 137 and the firing chamber being at or near its maximum volume.

Rearward movement of the trigger 160 against the bias of the trigger spring 161, e.g., by manual operation of the trigger 160 with the operator's finger(s), moves the trigger plate bore hole 165*a* centerline into a coaxial position with respect to the piston shaft 135 centerline, and the piston 130 and piston shaft 135 then can move rapidly in a forward stroke, as the weapon 110 is fired.

It should be apparent to one skilled in the art, based on the disclosure of the trigger assemblies shown for the embodiments in FIG. 1 and in this FIG. 2, that other trigger assembly mechanisms may be adapted for use in this invention, in place of the trigger assemblies described herein.

Yet another difference from the embodiment depicted in FIG. 1 is the presence of a noise-making assembly in the embodiment shown in FIG. 2. The noise-making assembly includes a striker collar 180 slidably mounted on the piston shaft 135, a striker collar spring 181 biasing the collar 180 in a forward direction along the shaft 135, a spring plate 182 with bore 182*a* retaining the rear of the striker collar spring 181 in a fixed position, a bushing 183 fixedly attached to the piston shaft 135, a lever 184 pivotally attached to the housing 111 at pivot point 185 to retain the striker collar in a rearward cocked position, and a lever spring 186 positioned to bias the pivoted lever 184 in contact with the striker collar 180.

The functionality of each of these elements is better understood by an explanation of the operation of the noise-making assembly. The noise-making assembly is operatively coupled to the piston 130, so that firing of the cocked toy weapon 110 operates the noise-making assembly without further involvement of the toy weapon's operator.

When the piston 130 is drawn back in a back stroke to cock the weapon 110, the bushing 183 attached to the piston shaft 135 moves rearward, concurrently moving the striker collar 180 rearward against the bias of the striker collar spring 181. The striker collar has a flat annular shoulder 180*a* on its forward facing side that can engage with a catch 184*a* on the spring-biased pivoted lever 184, for example, through a slot in the bottom of bushing 183 (not depicted) or by being oversized with respect to the bushing 183 as shown. When the striker collar 180 is moved fully rearwards by the bushing 183 during the back stroke movement of the piston 130 and piston shaft 135, the catch 184*a* on the lever 184 engages the flat shoulder 180*a* of the striker collar 180. The lever spring 186 holds the catch 184*a* on the shoulder 180*a* of the striker collar 180 after the weapon 110 is cocked, preventing the striker collar from moving in a forward direction under the bias of the compressed striker collar spring 181.

When the weapon 110 is fired by manually pulling the trigger 160, the bushing 183 attached on the piston shaft 135 travels forward with the forward-moving shaft and rides over the cam 184*b* on the lever 184, moving the pivoted lever in a downwards direction so as to disengage the catch 184*a* from the striker collar shoulder 180*a*. The striker collar 180, thus released and biased to move forward by the striker collar spring 181, moves forward along the shaft 135 until it strikes the bushing 183. The striking action makes a noise that is reminiscent of the sharp retort or pop of a gunshot.

It should be evident, in view of this disclosure, that other noise-making assemblies that are described in the prior art could be adapted by one skilled in the art for use in this invention, as a substitute for the noise-making assembly described above and that the noise making assembly can be modified for use with other toy weapons including but not limited to weapon 10 of FIG. 1.

It will be recognized by those skilled in the art that other changes could be made to the above-described embodiments and proposed embodiments of the invention without departing from the broad inventive concepts thereof. For instance, the piston shaft latch and trigger release might be omitted from each of the two embodiments and the piston and shaft advanced simply by release of the cocking mechanism or handle. It will further be appreciated that other cocking mechanisms might be employed for retracting the piston 130 and shaft 135 in a rearward direction, for example, a rack and tooth mechanism like that commonly employed in manually operated caulking guns, or a linkage or a pull cord and reel. Also, conventional firearm reloading member such as a slide pump-action handle or a rotating lever-action handle at the trigger might be provided to work whatever internal mechanism is used. Also, the reservoir could be located to one side of the tube 20 or 120 as well as above or below as shown. It should be understood, therefore, that the invention is not limited to the particular embodiments disclosed or suggested, but is intended to cover any modifications which are within the scope and spirit of the invention, as defined by the appended claims.

We claim:

1. A toy weapon for firing a charge of water comprising:

(a) a housing defining a body of a toy weapon;

(b) a tube supported by the housing, the tube defining a firing chamber to hold a charge of water;

(c) a pivotally mounted flap valve located at one end of the tube through which end a water charge exits under pressure upon firing of the charge, so as to effectively close the one end of the tube sufficiently to retain a static charge of water in the tube;

(d) a water reservoir external to the tube;

(e) a conduit coupling the reservoir to the tube in proximity of the flap valve;

(f) a one-way valve located between the reservoir and the tube and oriented to permit water to be drawn from the reservoir into the firing chamber;

(g) a piston mounted to reciprocate within the tube, such that the piston draws the charge of water from the reservoir into the firing chamber on a back stroke and pressurizes the charge in the firing chamber on a forward stroke and (h) a piston spring positioned to bias the piston in a forward stroke direction.

2. The toy weapon of claim 1 wherein the flap valve is spring biased to close the one end of the tube.

3. The toy weapon of claim 1 wherein the flap valve is hinge mounted at one end to provide the pivotal movement.

4. The toy weapon of claim 3 which further comprises a valve spring positioned to bias the flap valve to close the end of the tube.

5. The toy weapon of claim 1 which further comprises a nozzle located proximately to the flap valve, so as to direct a water charge passing through the valve.

6. The toy weapon of claim 1 which further comprises a hand grip and a piston shaft coupling the piston with the hand grip such that the piston may be manually moved in a back stroke that compresses the piston spring.

7. The toy weapon of claim 1 which further comprises a cocking means for moving the piston in a back stroke that compresses the piston spring and a piston shaft attached at one end to the piston and operatively linked at an opposing end to the cocking means.

8. The toy weapon of claim 1 which further comprises a cocking means operatively linked to the piston for moving the piston in a back stroke that compresses the piston spring, a latch member located and operatively mounted to maintain the piston in a cocked position, and a trigger operatively associated with the latch member to effect release of the cocked piston into a forward stroke.

9. The toy weapon of claim 8 which further comprises a noise-making assembly operatively associated with the piston cocking means, such that release of the cocked piston effects concurrent operation of the noise-making assembly.

10. The toy weapon of claim 1 which further comprises a noise-making assembly operatively coupled with the piston.

11. The toy weapon of claim 10 wherein the noise-making, assembly is mounted to strike a portion of the weapon, to provide a sharp retort when the piston moves in a forward stroke.

12. The toy weapon of claim 1 wherein the water reservoir is non-pressurized.

13. The toy weapon of claim 1 wherein the water reservoir is located above the tube in the housing.

14. The toy weapon of claim 1 wherein the water reservoir is located below the tube in the housing.

15. The toy weapon of claim 1 wherein the housing is in the shape of a gun.

16. In a spring-operated toy weapon having a housing in the shape of a weapon and having an operational firing assembly containing a shaft operatively linked to a shaft spring that biases shaft movement in a longitudinal direction, an improvement in a cocking and release mechanism which comprises:

(i) a cocking lever, pivotally attached to the housing;

(ii) a cocking latch, having a bore hole, slightly larger than the shaft diameter, through which the shaft passes;

(iii) a cocking latch spring positioned to bias the cocking latch into a position that maintains the bore hole centerline and shaft centerline in a relationship sufficiently coaxial to permit the shaft to slide loosely through the bore hole;

(iv) a rotary member associated with the cocking lever and positioned proximate to the cocking latch, the rotary member being rotatable by manual movement of the cocking lever about a pivot point to make contact with the cocking latch and to misalign the cocking latch bore hole sufficiently with respect to the shaft to effect frictional engagement of the shaft with at least a portion of the bore hole periphery to move the shaft in a back stroke direction; and (v) a trigger latch in contact with the shaft so as to prevent the shaft from moving in a forward stroke direction when coaxial with the cocking latch bore hole; and (vi) a trigger finger grip portion protruding beyond the exterior of the housing and operatively linked to the trigger latch so as to release the shaft from the trigger latch.

17. A toy weapon for firing a charge of water comprising:

(a) a housing defining a body of a toy weapon;

(b) a tube supported by the housing, the tube defining a firing chamber to hold a charge of water;

(c) a pivotally mounted flap valve located at one end of the tube through which end a water charge exits under pressure upon firing of the charge, so as to effectively close the one end of the tube sufficiently to retain a static charge of water in the tube;

(d) a water reservoir external to the tube;

(e) a conduit coupling the reservoir to the tube in proximity of the flap valve;

(f) a one-way valve located between the reservoir and the tube and oriented to permit water to be drawn from the reservoir into the firing chamber; and (g) a piston mounted to reciprocate within the tube, such that the piston draws the charge of water from the reservoir into the firing chamber on a back stroke and pressurizes the charge in the firing chamber on a forward stroke;

wherein the flap valve is substantially rigid and wherein the toy weapon further comprises a clevis formed by a pair of fork arms, one end of the flap valve being supported on the fork arms for rotation about a pivot axis through the fork arms.

18. The toy weapon of claim 17 further comprises a soft, flexible gasket affixed to a tube closing side of the flap valve.

19. A method of operating a toy weapon for firing a charge of water, the toy weapon including a housing defining a body of a toy weapon; a tube supported by the housing, the tube defining a firing chamber to hold a charge of water; a pivotally mounted flap valve located at one end of the tube through which end a water charge exits under pressure upon firing of the charge, so as to effectively close the one end of the tube sufficiently to retain a static charge of water in the tube; a water reservoir external to the tube; a conduit coupling the reservoir to the tube in proximity of the flap valve; a one-way valve located between the reservoir and the tube and oriented to permit water to be drawn from the reservoir into the firing chamber; and a piston mounted to reciprocate within the tube, such that the piston draws the charge of water from the reservoir into the firing chamber on a back stroke and pressurizes the charge in the firing chamber on a forward stroke, the method comprising the steps of:

loading the reservoir with water;

drawing the piston on a back stroke rearward throughout the tube to expand the volume of the firing chamber and create a partial vacuum within the chamber to draw water from the reservoir through the conduit an the one-way valve into the firing chamber;

releasably securing the piston in a retracted position maintaining the expanded volume of the firing chamber while retaining water in the firing chamber with the flap valve; and releasing the piston to move in a forward stroke reducing the volume of the firing chamber and pressurizing water within the chamber, the pressurized water opening the flap valve and discharging from the chamber through the conduit and flap valve.

* * * * *